US005243736A

United States Patent [19]

Cannaday et al.

[11] Patent Number: 5,243,736

[45] Date of Patent: Sep. 14, 1993

[54] DRAWER STOP

[75] Inventors: Harry Cannaday, Morristown; John D. Utt, Talbott, both of Tenn.

[73] Assignee: Universal Furniture Industries, Inc., High Point, N.C.

[21] Appl. No.: 856,620

[22] Filed: Mar. 24, 1992

[51] Int. Cl.[5] ..... E05F 5/02

[52] U.S. Cl. ..... 16/82; 16/86 A; 16/96 R; 312/330.1; 312/334.27; 312/334.44

[58] Field of Search ..... 16/82, 86 R, 86 A, 96 R, 16/337; 312/330.1, 334.27, 334.34, 334.44, 350

[56] References Cited

U.S. PATENT DOCUMENTS

| | | |
|---|---|---|
| 1,535,446 | 4/1925 | Atwood . |
| 2,060,708 | 10/1936 | Wegener . |
| 3,039,838 | 6/1962 | Koch, Jr. et al. . |
| 3,099,501 | 7/1963 | Hillson et al. . |
| 3,639,028 | 2/1972 | Black . |
| 3,650,577 | 3/1972 | Gutner . |
| 3,926,492 | 12/1975 | Gutner . |
| 4,084,290 | 4/1978 | Lymar et al. . |
| 4,449,766 | 5/1984 | Shook . |
| 4,502,741 | 3/1985 | DeVries et al. . |
| 4,692,960 | 9/1987 | Jozefczak . |

FOREIGN PATENT DOCUMENTS 772785 11/1934 France ..... 16/86 A

OTHER PUBLICATIONS

Allport's Patent Door Buffers, Feb. 18, 1888.

*Primary Examiner*—W. Donald Bray

*Attorney, Agent, or Firm*—Edgar A. Zarins; Malcolm L. Sutherland

[57] ABSTRACT

A drawer stop to prevent the unintentional removal of drawer assemblies by creating a frictional stop of the drawer at the front parting rail of the case good. The frictional engagement can be overcome to remove the drawer by sharply withdrawing the drawer. The drawer stop is attached to the female drawer guide on the bottom of the drawer assembly. The stop mechanism is manufactured from a low density polyethylene which has the compressive resiliency to allow the frictional engagement to be overcome. The stop may be secured to the bottom of the drawer by nails or hot melt glue or both.

12 Claims, 1 Drawing Sheet

DRAWER STOP

BACKGROUND OF THE INVENTION

1. Field of the Invention

This invention relates to mechanisms for preventing the inadvertent removal of a drawer from its dresser or the like and, in particular, to a compressible drawer stop which creates a frictional engagement at the end of the drawer travel yet allows removal of the drawer if desired.

2. Description of the Prior Art

The unintentional removal of a drawer from its case good such as a dresser can be an unnerving and possibly harmful experience. Accordingly, mechanisms have been developed which absolutely prevent the removal of the drawer or require careful manipulation for removal of the drawer. Although unexpected removal of the drawer upon withdrawal is undesirable, many situations require intentional removal. The positive drawer stops can be tedious to disengage in order to remove the drawer. In addition, the complexity of the drawer stop adds weight to the case good as well as the cost of manufacturing.

SUMMARY OF THE PRESENT INVENTION

The present invention overcomes the disadvantages of the prior known drawer stops by providing a lightweight and inexpensive frictional drawer stop which prevents unintentional withdrawal of the drawer but facilitates simple removal and replacement within the case good.

In a preferred embodiment of the present invention, the drawer stop is secured to a guide formed on the bottom side of the drawer. In the simple drawer construction, the drawer guide comprises a guide rail extending the depth of the drawer which receives and rides on a rail secured within the case good. The drawer stop is mounted to the guide rail proximate the back of the drawer thereby allowing partial withdrawal without hinderance. As the drawer is withdrawn, the drawer stop will frictionally engage a lateral parting rail mounted at the front of the case good. It is this engagement which retards further withdrawal of the drawer from the case good.

The drawer stop of the present invention is preferably molded from a low density polyethylene material to provide compressive resiliency. The stop has a rectilinear upper edge to facilitate mounting to the drawer and a semi-circular lower edge to produce an increased frictional engagement which may be overcome through sufficient force. The combination of the semi-circular lower edge and the compressive nature of the material composition of the stop creates the frictional engagement but allows removal of the drawer. Under normal use, the stop will engage the parting rail preventing removal of the drawer. If removal is desired, additional refraction force may be applied to overcome the frictional engagement of the stop.

Other objects, features and advantages of the invention will be apparent from the following detailed description taken in connection with the accompanying drawings.

BRIEF DESCRIPTION OF THE DRAWING

The present invention will be more fully understood by reference to the following detailed description of a preferred embodiment of the present invention when read in conjunction with the accompanying drawing, in which like reference characters refer to like parts throughout the views and in which.

DETAILED DESCRIPTION OF A PREFERRED EMBODIMENT OF THE PRESENT INVENTION

Figure 1:
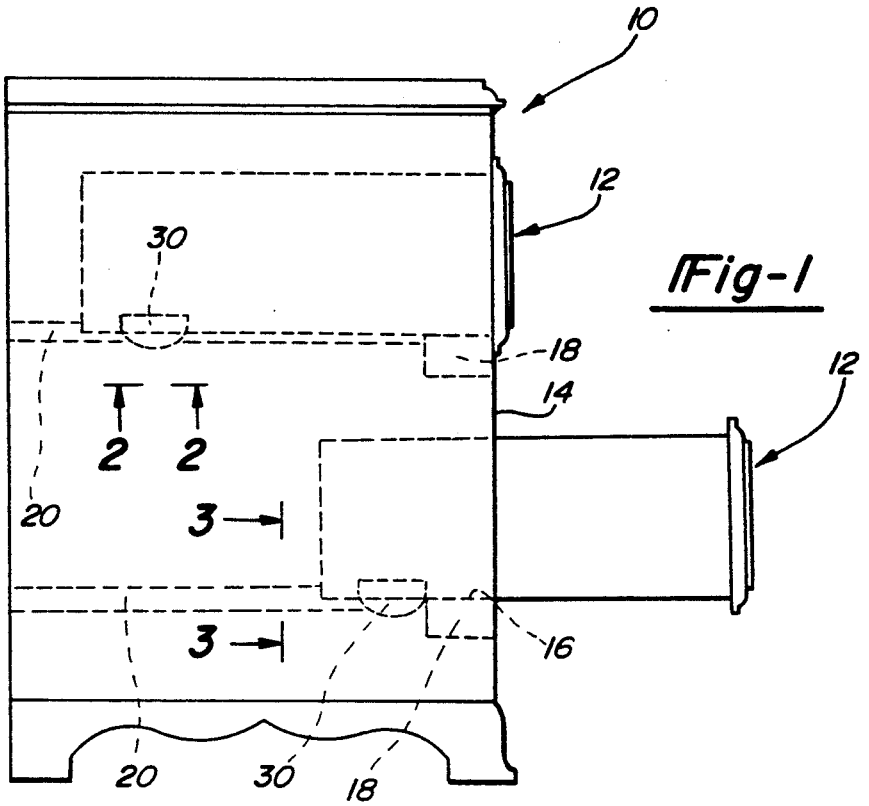
FIG. 1 is a side plan view of a dresser incorporating drawers embodying the present invention.
Figure 2:
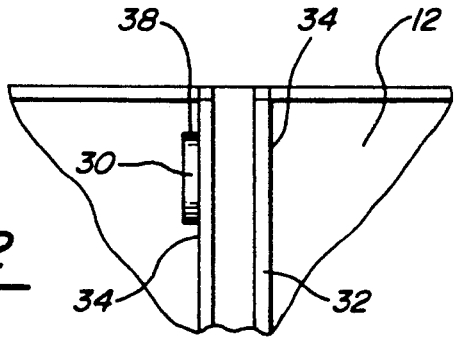
FIG. 2 is a fragmentary bottom view of the drawer with the drawer stop mounted thereto.

Referring first to FIG. 1, there is shown a dresser 10 which is typical of case goods incorporating a withdrawable drawer 12. The dresser 10 includes a frame 14 having at least one opening 16 for receiving the drawer 12. The drawer 12 is supported at the front face of the dresser 10 by a parting rail 18 extending horizontally across the dresser 10. The drawer 12 is supported within the dresser 10 by a rail 20 extending from the parting rail 18 to the rear of the dresser 10. In the typical dresser drawer assembly, a single central rail 20 is utilized to guide the movement of the drawer 12 although two or more rails may be employed in wider or heavier drawers 12. As a consequence of this construction, the drawer 12 may be repeatedly withdrawn and returned within the dresser 10. If desired, the drawer 12 may be completely removed from the dresser 10.

Figure 3:
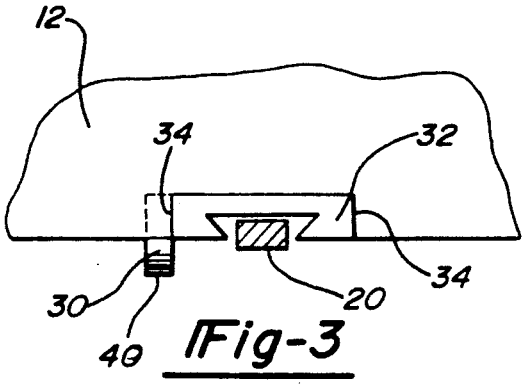
FIG. 3 is a fragmentary end view of the drawer with the drawer stop mounted thereto.
Figure 4:
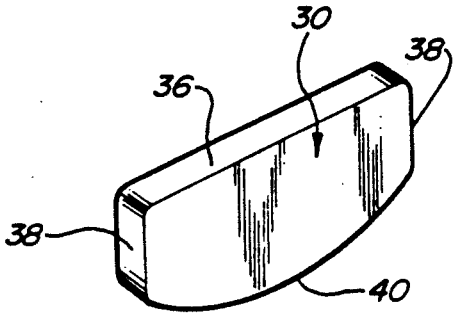
FIG. 4 is a perspective view of the drawer stop embodying the present invention.

Referring now to FIGS. 1 through 4, in order to prevent inadvertent removal of the drawer 12 from the dresser 10 but still permit removal if desired, the drawer 12 is provided with a drawer stop 30. In a preferred embodiment of the present invention, the stop 30 is mounted to a guide rail 32 formed on the underside of the drawer 12. The stop 30 is mounted proximate the rear of the drawer 12 such that the drawer 12 may be partially withdrawn before the stop 30 engages the parting rail 18 inhibiting complete withdrawal of the drawer 12. The guide rail 32 is proportioned to receive and slide along the inner guide 20 of the dresser 10 as best shown in FIG. 3. The drawer stop 30 is mounted to an exterior side surface 34 of the guide rail 32 using an adhesive and/or nails. The stop 30 extends below the bottom of the drawer 12 in order to engage the parting rail 18.

The drawer stop 30 is preferably constructed of a compressibly resilient material, such as a low-density polyethylene, in order to create a frictional engagement with a parting rail 18. The stop 30 has a substantially planar configuration with a rectilinear upper edge 36 and end edges 38. A semi-circular lower edge 40 creates a progressive frictional engagement which can be overcome with increased force in contrast to the blunt stops of the prior art. It is the semi-circular lower edge 40 which engages the parting rail 18.

The resilient nature of the drawer stop 30 creates a frictional engagement which prevents inadvertent removal of drawer 12 but allows intentional removal through increased force. As the drawer 12 is withdrawn under normal use, the stop 30 will move forward with the drawer 12. Withdrawal will be impeded when the semicircular lower edge 40 of the stop 30, which extends below the rail 32, engages the parting rail 18. In the event removal of the drawer 12 is desired, a sudden or increased withdrawal force may be applied to the drawer 12 to compress the lower edge 40 of the stop 30 allowing it to pass by the parting rail 18. Upon insertion of the drawer 12, additional force will again be required to compress the stop 30 to allow it to pass over the parting rail 18. Thus, the present invention provides a lightweight and simple drawer stop which may be readily attached to any conventional drawer to impede the inadvertent removal of a dresser drawer upon withdrawal.

The foregoing detailed description has been given for clearness of understanding only and no unnecessary limitations should be understood therefrom as some modifications will be obvious to those skilled in the art without departing from the scope and spirit of the appended claims.

What is claimed is:

1. In a furniture piece having a t least one drawer selectively removable from the furniture piece and reciprocally withdrawable within the furniture piece for selective access to the interior of the drawer, the at least one drawer including means for guiding reciprocal movement within the furniture piece and the furniture piece having a horizontal parting rail transverse to the direction of withdrawal of said at least one drawer and a longitudinal rail for supporting an underside of said at least one drawer, the improvement comprising:

a drawer stop mounted to the underside of said at least one drawer to retard inadvertent removal of said at least one drawer upon withdrawal, said drawer stop selectively frictionally engaging the parting rail within the furniture piece upon withdrawal of said at least one drawer, said drawer stop being made of a resiliently compressible material whereby said frictional engagement is selectively overcome upon application of a withdrawal force compressing said drawer stop past the parting rail to remove said at least one drawer from the furniture piece.

2. The improvement as defined in claim 1 wherein said drawer stop has a semicircular lower edge which engages the parting rail upon withdrawal of said at least one drawer, said semicircular lower edge creating a variable frictional engagement with the parting rail.

3. The improvement as defined in claim 2 wherein said at least one drawer includes a guide rail on the underside thereof, said guide rail matingly engaging the longitudinal rail of the furniture piece, said drawer stop mounted to said guide rail.

4. The improvement as defined in claim 3 wherein said drawer stop has a substantially planar configuration with rectilinear upper and end edges and said semicircular lower edge, said drawer stop mounted to said guide rail on the underside of said at least one drawer with said semicircular lower edge facing downwardly.

5. The improvement as defined in claim 4 wherein said drawer stop is added to said at least on drawer to prevent inadvertent removal thereof, said drawer stop nailed to said guide rail.

6. The improvement as defined in claim 3 wherein said drawer is made of a low density polyethylene material.

7. A drawer stop to prevent inadvertent removal of a drawer, the drawer reciprocally withdrawable within a frame, the frame including a front parting rail, said drawer stop comprising;

a substantially planar body having a semi-circular lower edge mounted to the underside of the drawer, said semicircular lower edge of said stop frictionally engaging the front parting rail of the frame upon withdrawal of the drawer retarding removal of the drawer from the frame, said frictional engagement capable of being overcome upon the application of a threshold force to move said drawer stop past the front parting rail.

8. The drawer stop as defined in claim 7 wherein said drawer stop is made of a resiliently compressible material to overcome said frictional engagement upon application of said threshold force.

9. The drawer stop as defined in claim 7 wherein said drawer stop has a rectilinear upper edge, said upper edge engaging the underside of the drawer upon mounting said drawer stop to a guide rail of said drawer, a side face of said drawer stop engaging the guide rail.

10. The drawer stop as defined in claim 9 wherein said drawer stop is mounted to the guide rail on the underside of the drawer using at least one fastener.

11. In a furniture piece having a drawer selectively removable from the furniture piece and reciprocally withdrawable within the furniture piece for selective access to the interior of the drawer, the drawer including a guide rail formed on the underside thereof for guiding reciprocal movement within the furniture piece and the furniture piece having a horizontal parting rail for supporting the drawer within the furniture piece, the parting rail mounted proximate the front face of the furniture piece, the improvement comprising:

a drawer stop mounted to the guide rail on the underside of said drawer to prevent inadvertent removal of said drawer upon withdrawal within the furniture piece, said drawer stop having a substantially planar body with a semicircular lower edge which frictionally engages the parting rail upon withdrawal of said drawer, said frictional engagement capable of being overcome upon application of a threshold withdrawal force to move said drawer stop past the parting rail.

12. The improvement as defined in claim 11 wherein said drawer stop is made of a resiliently compressible material, said drawer stop being partially compressed upon application of said threshold force to move said drawer stop past the parting rail.

* * * * *